United States Patent [19]

Olson et al.

[11] Patent Number: 4,848,589

[45] Date of Patent: Jul. 18, 1989

[54] USER EXPANDABLE CONTAINER

[76] Inventors: Bradley J. Olson, 2001 Terraza Pl., Fullerton, Calif. 92635; Roberto A. Cueva, 8114 Camino Tranquilo, San Diego, Calif. 92122

[21] Appl. No.: 147,151

[22] Filed: Jan. 21, 1988

[51] Int. Cl.[4] ..... B65D 5/36; B65D 5/54

[52] U.S. Cl. ..... 206/621.1; 229/41 B; 229/122.1; 229/136; 229/DIG. 4

[58] Field of Search ..... 229/41 R, 41 B, 125.42, 229/138, 122.1, DIG. 4, 136, 137; 206/621.1, 621.2, 631.3; 383/84–86

[56] References Cited

U.S. PATENT DOCUMENTS

| | | | |
|---|---|---|---|
| Re. 26,305 | 11/1967 | Huang et al. | 229/17 |
| Re. 26,742 | 12/1969 | Laskow | 229/136 |
| 1,157,462 | 10/1915 | Wormer | 206/621.2 |
| 1,317,687 | 10/1919 | Cooper | 229/41 R |
| 2,337,199 | 12/1943 | Holy | 229/41 |
| 2,400,716 | 5/1946 | Sattler | 229/41 R |
| 2,761,609 | 9/1956 | Arkin | 229/23 |
| 2,933,232 | 4/1960 | Bugnone | 229/41 B |
| 3,059,826 | 10/1962 | Harms | 229/137 |
| 3,074,617 | 1/1963 | Kindseth et al. | 229/55 |
| 3,212,697 | 10/1965 | Anderson | 229/57 |
| 3,306,521 | 2/1967 | Giacovas | 229/136 |
| 3,366,308 | 1/1968 | Phillips, Jr. | 229/41 B |
| 3,526,566 | 9/1970 | McIlvain, Jr. et al. | 229/DIG. 4 |
| 3,565,325 | 2/1971 | Pugsley | 229/37 |
| 3,726,469 | 4/1973 | Koehler | 229/41 B |
| 4,313,553 | 2/1982 | Lisiecki | 206/631.3 |
| 4,410,129 | 10/1983 | Wischusen, III | 229/41 B |
| 4,566,607 | 1/1986 | Smith | 229/122.1 |

FOREIGN PATENT DOCUMENTS

| | | | |
|---|---|---|---|
| 645033 | 7/1962 | Canada | 206/631.3 |
| 3038798 | 6/1981 | Fed. Rep. of Germany | 206/621.2 |
| 2458480 | 2/1981 | France | 229/122.1 |
| 334239 | 9/1936 | Italy | 383/86 |
| 315243 | 9/1969 | Sweden | 206/621.2 |

*Primary Examiner*—Gary Elkins

*Attorney, Agent, or Firm*—Price, Gess & Ubell

[57] ABSTRACT

A container blank suitably scored to construct an expandable, collapsible gable topped container having a pouring spout sealable by an integral adhesive-bearing flap.

4 Claims, 6 Drawing Sheets

USER EXPANDABLE CONTAINER

BACKGROUND OF THE INVENTION

1. Field of the Invention

The subject invention relates to containers, and more particularly to an easily stored expandable and selectively sealable container particulalry adapted for multiple applications.

2. Description of Related Art

In the medical arts, containers are frequently used to collect and temporarily store a specimen. Thereafter, the container is disposed of. One familiar example is the collection of urine specimens, which typically employs plastic cups. Such cups have several disadvantages. Most obvious, they require a separate cap for sealing and, if not properly capped, are subject to spillage of their liquid contents. In addition, they are relatively bulky for purposes of storage and disposal and are not space efficient when sterile-wrapped. Their shape is also not ideally suited for some purposes. Various combinations of these problems are also encountered in storing of other materials in different environments, including commercial laboratories, the food and automotive industries and consumer usage.

Various carton structures are, of course, known in the prior art. U.S. Pat. No. Re. 26,305 is a typical example which provides storage and pouring of liquids. However, such structures do not satisfy the need for an expandable/collapsible and manually sealable container which eliminates the aforementioned disadvantages.

SUMMARY OF THE INVENTION

Accordingly, it is an object of the invention to provide an improved container;

It is another object of the invention to provide an improved container for medical purposes;

It is yet another object of the invention to provide a container which may be stored in a collapsed state and expanded for use.

It is a further object to provide a convenient attached adhesive closure mechanism which creates a leak resistant and reopenable seal.

It is a further object of the invention to provide such a container from which liquid contents may readily be poured.

Accordingly, the invention provides a carton blank suitably scored to provide an expandable and collapsible container with an adhesive strip mounted on an extended tab. The adhesive strip may be exposed and used to seal the container. The container may be suitably coated to be impermeable to liquids according to procedures known in the art.

The container according to the preferred embodiment has many advantages. It may be stored flat (collapsed) awaiting use, thereby minimizing necessary storage space. The collapsed configuration allows expansion (opening) of the stored container without manipulating the interior of the device. The closure mechanism and integral sealed bottom make the container highly resistant to leakage of liquid contents. The attached adhesive closure mechanism obviates the need for a cap, clip or external binding to seal the container. The flexible opening provided facilitates pouring, placement and removal of materials in and out of container. Once sealed, the container can be easily opened without contact or contamination of its contents. Once opened after sealing, pouring of the liquid contents is accomplished via a spout formed by the configuration of the top and the closure mechanism. Once the container has been used, it is easily collapsed for space efficient disposal.

Each container can also be individually wrapped for sterile uses without significantly affecting space efficient storage. Variation in the composition of coating materials provides the opportunity for use in multiple applications. Depending on the composition of the coating materials, the container may be constructed to withstand extremes in temperature (e.g., freezing, heating in an oven or microwave).

The configuration of the container provides numerous individual flat surfaces to facilitate the ease of marking and labeling for identification. The paperboard composition provides both an opaque surface allowing concealment of the contents (useful with medical specimens) and permits incineration or biodegradable disposal.

DETAILED DESCRIPTION OF THE PREFERRED EMBODIMENTS

Figure 1:
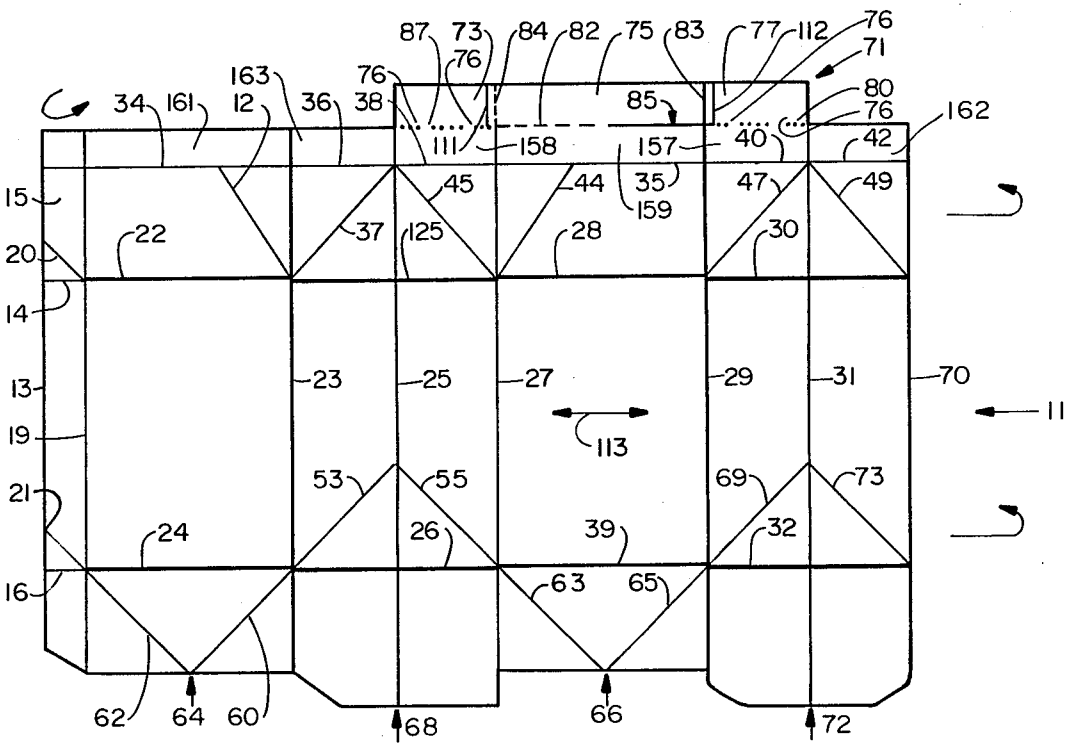
FIG. 1 is a plan view illustrating the preferred embodiment of the invention.

FIG. 1 illustrates a blank 11 according to the preferred embodiment, composed of paperboard or other suitable material and die cut and scored as shown. In a paperboard embodiment, the grain of the paper is in the direction indicated by an arrow 113. The scoring permits folding or creasing along the lines illustrated to permit formation, collapsing, and expanding of the container of the preferred embodiment, as will be described in further detail. FIG. 1 illustrates the surface of the blank 11, which becomes the inside of the container according to the preferred embodiment.

Beginning at the left most edge, a side flap 15 is formed by a vertical score 19. Additional vertical score lines 23, 25, 27, 29, and 31 are formed across the blank 11. Horizontal score lines 14, 16 are formed in the flap 15 between its outside edge 13 and vertical score 19. Diagonal score lines 20, 21 are formed in the flap 15 extending diagonally upward, respectively from the terminations of horizontal score lines 14, 16 at vertical score line 19.

Horizontal score lines 22, 24 formed between the first and second vertical score lines 19, 23 respectively disposed slightly above horizontal score lines 14, 16. Additionally, a horizontal score line 34 is formed near the top edge of the blank 11 between the vertical score line 23 and edge 13 of the flap 15. A diagonal score line 12 extends upwardly to horizontal score line 34 from the intersection of vertical score line 23 and horizontal score line 22. Diagonal score lines 60 and 62 form an equilateral triangle between vertical score lines 19, 23 having its apex lying on bottom edge 64 and terminating respectively at the intersection of horizontal score line 24 with vertical score lines 19, 23.

Between the second and fourth vertical score lines 23, 27 is formed the third vertical score line 25 and additional horizontal and diagonal scoring, including horizontal scores 125, 26. The horizontal scores 125 and 26 are formed just below horizontal scores 22, 24, respectively. Score lines 36 and 38 are formed near the top between the second and fourth score lines 23, 27 and extend slightly diagonally downwardly to intersect at the third vertical score 25. A first pair of upward-extending diagonal scores 37, 45 form an equilateral triangle having an apex lying on vertical score 25 at the intersection of the downardly-extending scores 36, 38. The first pair of upwardly-extending diagonal scores 37, 45 begin at the respective intersections of horizontal score 125 with the second and fourth vertical scores 23, 27. A second pair of upwardly-extending diagonal scores 53, 55 form an equilateral triangle having an apex lying on the third vertical score line 25 and extending respectively to the intersection of horizontal score 26 and the second vertical score 23 and the intersection of the horizontal score 26 with the fourth vertical score 27.

Finally, it may be noted that an extended bottom flap 68 is formed between the second and fourth vertical score lines 23, 27. It may be further observed that the third vertical score 25 and the second pair of upwardly-extending diagonal scores 53, 55 particularly contribute to the expandable/collapsible nature of the preferred embodiment.

Between the fourth and fifth vertical scores 27, 29 are formed two horizontal score lines 28, 39 disposed respectively slighlty above adjacent horizontal score lines 125, 26. A diagonal score line 44 extends upwardly from the intersection of the fourth vertical score 27 and the horizontal score 28 to intersect a horizontal score 35. A pair of diagonal score lines 63, 65 forms an equilateral triangle having an apex on the bottom edge 66 of the blank 11. The diagonal score lines, 63, 65 extend from the apex to the respective intersections of horizontal score 39 with the fourth and fifth vertical scores 27, 29.

A number of horizontal and diagonal scores and the sixth vertical score 31 are formed between the fifth and seventh vertical scores 29, 70. The horizontal scoring includes horizontal scores 30, 32 formed slightly below adjacent horizontal scores 28, 29. Two scores 40, 42 are formed near the top between the fifth and seventh scores 29, 70 and extend slightly diagonally downwardly to intersect at the sixth vertical score 31. A third pair of upwardly-extending diagonal scores 47, 49 form an equilateral triangle having an apex lying on vertical score 31 at the intersection of the downwardly-extending scores 40, 42. The first pair of upwardly-extending scores 47, 49 begin respectively at the intersections of horizontal score 30 and the fifth and seventh vertical scores 29, 70. A fourth pair of upwardly-extending diagonal scores 69, 73 form an equilateral triangle with its apex lying on the sixth vertical score 31 and extend respectively to the intersections of horizontal score 32 with the fifth and seventh vertical scores 29, 70. A second extended flap 72 is formed between the fifth and seventh vertical scores 29, 70. It may be observed that the sixth vertical score 31 and the diagonal scores 69, 73 further cooperate in realizing the collapsible/expandable nature of the container of the preferred embodiment.

An additional feature of the preferred embodiment is the sealing tab or flap 71 formed at the upper end of the blank 11, which provides a user sealing/opening function. Depending on the application, a resealing function may also be provided. The tab 71 includes respective end tabs 73, 77. The first end tab 73 is defined by a scored and perforated vertical edge 84, a scored and nonperforated vertical edge 111, and a horizontal edge 87. The edge 87 is attached to the body of the blank 11 only by two uncut segments 76 and is otherwise cut away from the blank 11. The second end tab 77 is defined by a scored vertical edge 83, a second vertical edge 112, and a horizontal edge 80. The horizontal edge 80 is again attached only by two uncut segments 76 and is otherwise cut away from the body of the blank 11. The edges 80, 87 thus are constructed as cut-uncut-cut-uncut-cut. The middle section 75 of the tab is defined by the vertical edges 84, 83 and a horizontal edge which includes a perforated and scored section 82 and a nonperforated scored section 85. Scoring and perforation permits the dual function of folding and tearing, as later illustrated.

In operation, the uncut segments secure the end tabs 73, 77 during manufacture. During user sealing of the container, the uncut segments are easily and necessarily broken, freeing the end tabs 73, 77 to be folded about edges 84, 83, respectively. The perforation on edges 84 and 82 permit easy separation and reopening of the gabled container top after it has been sealed by a user, as will be illustrated in further detail. The unperforated vertical scores 111, 112 accommodate the thickness of the flap 71 and thus facilitate folding of the end tabs 73, 77 about the end flap 71, as shown, for example, in FIG. 8.

Figure 2:
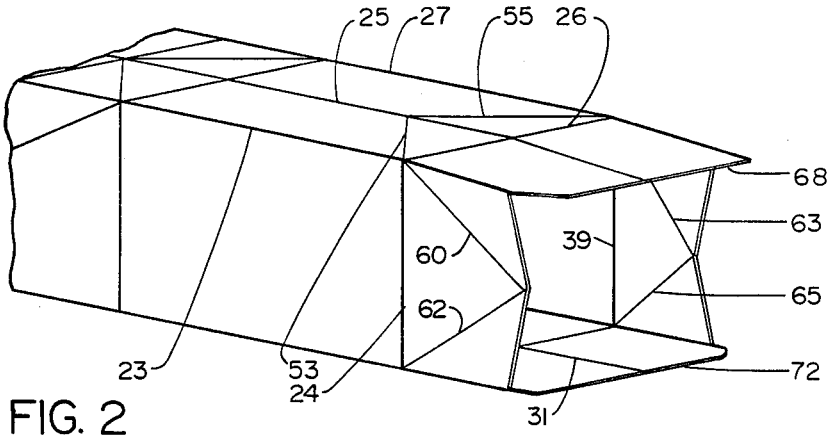
FIG. 2 is a perspective illustrating the preferred embodiment.
Figure 3:
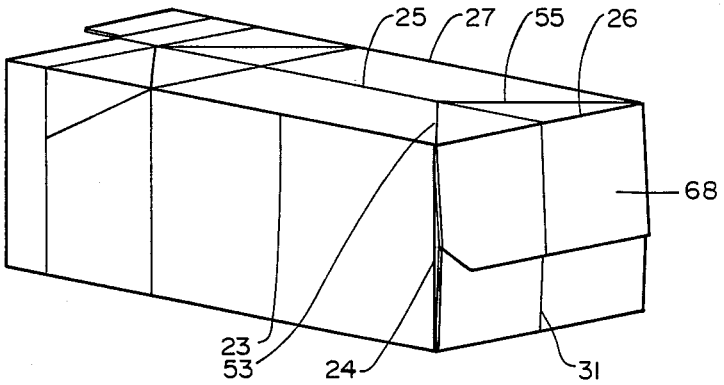
FIG. 3 is a side view illustrating the preferred embodiment.

In manufacture, the blank is erected into a box shape and the bottom is sealed. Flap 15 is folded over at score 19 against the blank 11. The blank 11 is then bent at scores 23, 27, 29 and the inside surface at edge 70 is caused to completely overlap the exposed (outside) surface of the flap 15. The bottom is created by folding along horizontal scores 24, 26, 39 and 32 and diagonal scores 62, 60, 63, 65, FIG. 2, and heat sealing as known in the art. Bottom flap 68 overlaps bottom flap 72, to complete formation of an open-ended box, as shown in FIG. 3.

Figure 4:
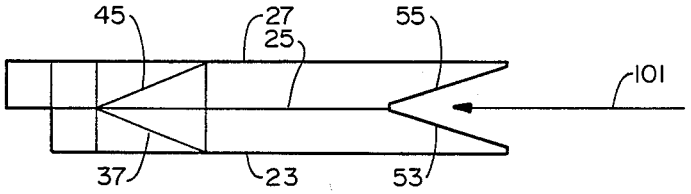
FIG. 4 is a perspective illustrating the preferred embodiment.
Figure 5:
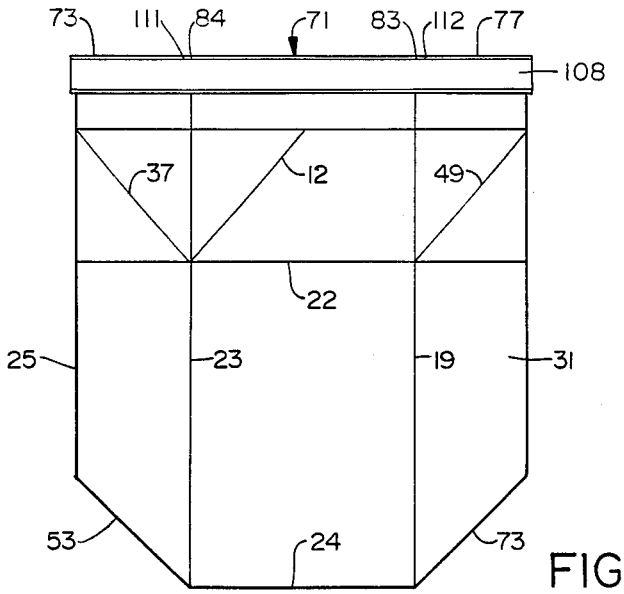
FIG. 5 is a top plan view illustrating the preferred embodiment.

At this point, the box shape is flattened by pushign in at the bottom, in the direction of the arrow 101 shown in FIG. 4, and pushing the side panels together. This pushing-in operation may be performed mechanically and causes creasing along scores 25, 31, assisted by diagonal scores 53, 55, 69, 73 which aid in creasing the bottom. As a result, the bottom goes in and the sides go out, forming a flat container of the shape shown in FIG. 5. FIG. 5 further illustrates a release paper 108 which overlies an adhesive strip applied to the flap 71 to provide a sealing function as hereafter described.

Figure 6:
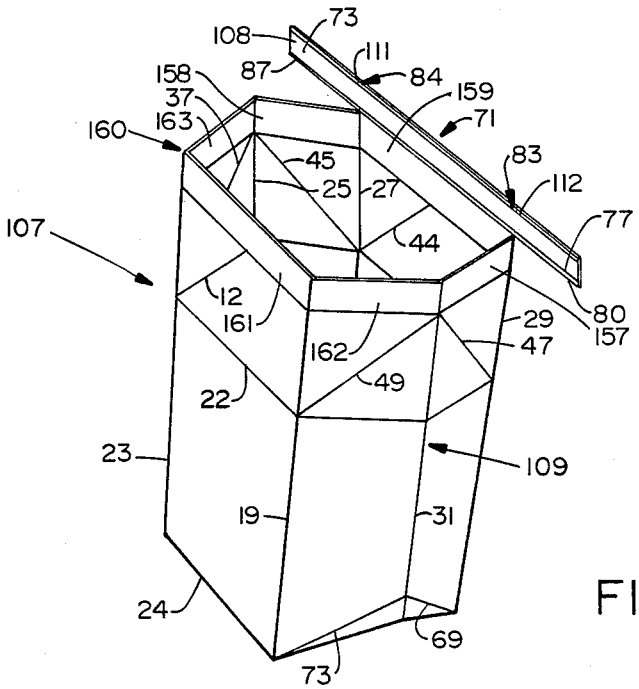
FIG. 6 is a perspective illustrating the preferred embodiment.
Figure 7:
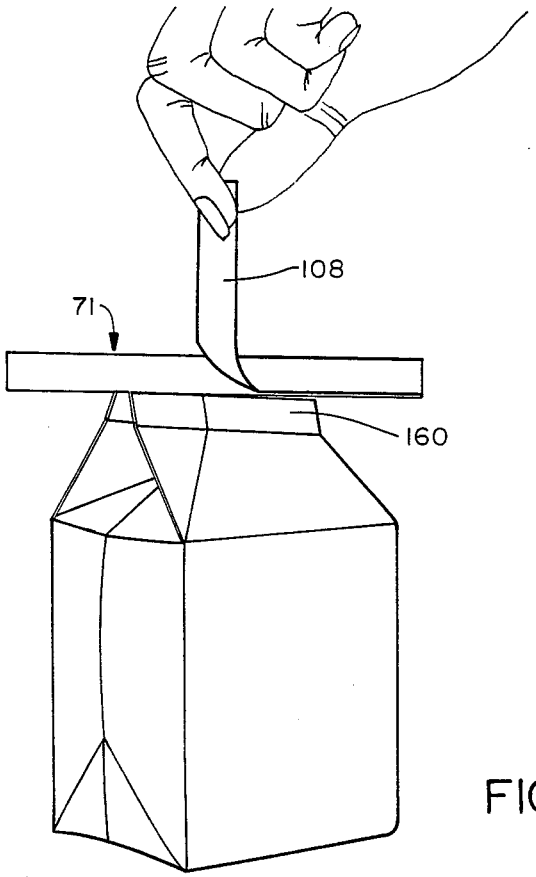
FIG. 7 is a perspective illustrating the preferred embodiment.
Figure 8:
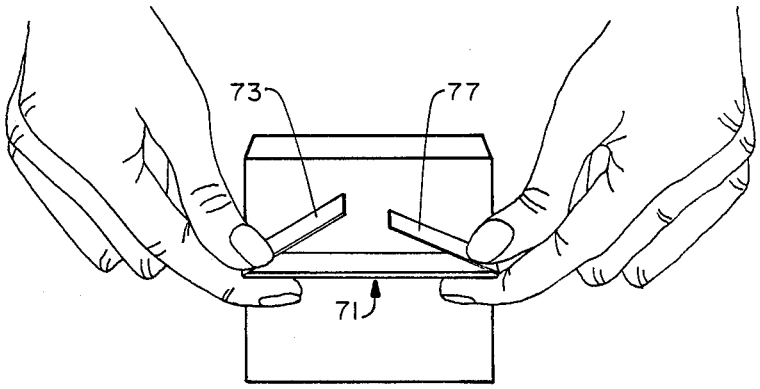
FIG. 8 is a perspective illustrating the preferred embodiment.
Figure 9:
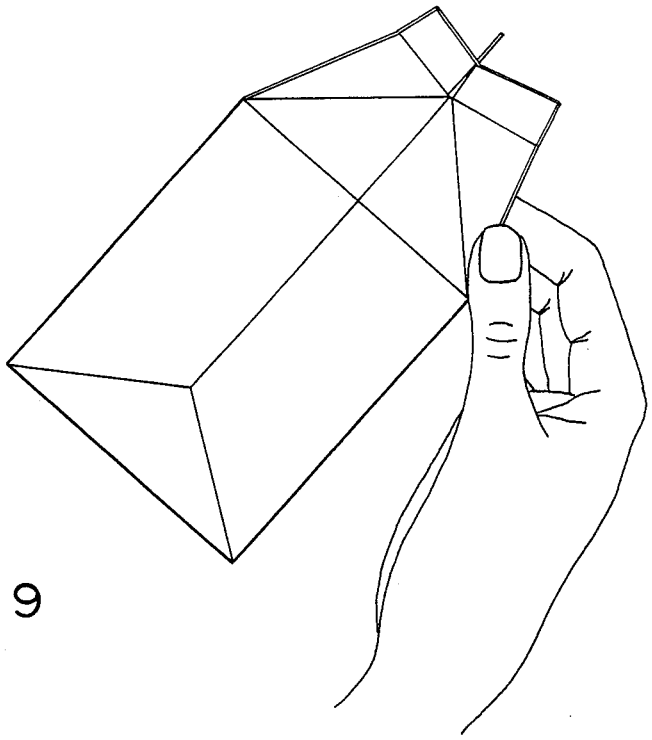
FIG. 9 is a perspecitve illustrating the preferred embodiment.
Figure 10:
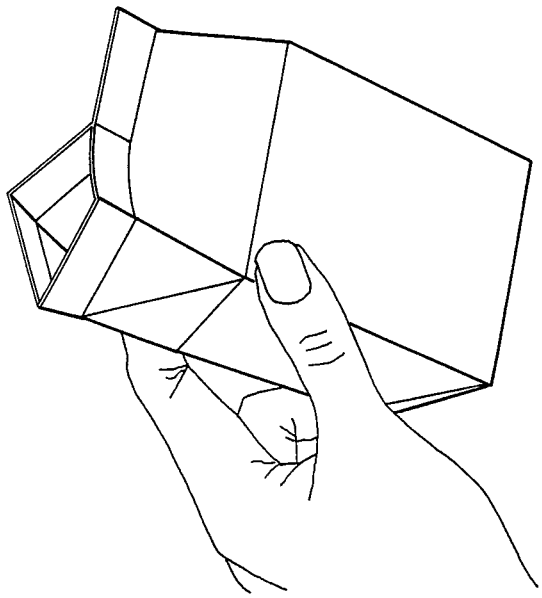
FIG. 10 is a perspective illustrating the preferred embodiment.

In FIG. 6, the flattened carton has been "popped" open for use by application of pressure near the middle of the side seams 25, 31, as illustrated by the arrows 107, 109, so that its enclosed volume may be filled with a desired liquid. The top scores 20, 12, 36, 37, 38, 45, 44, 34, 35, 40, 42, 47, 49 cooperate to provide a bagled top closure similar to a conventional milk carton. As shown, this closure includes a vertical lip 160 having a middle panel 159 to which the flap 71 is attached. The middle panel 150 is flanked by first and second side panels 157, 158. The vertical lip 160 further includes a middle panel 161 disposed opposite middle panel 150 and flanked by its adjacent side panels 162, 163. Once filled, or prior to filling , if desired, the release paper 108 is removed from the adhesive strip as illustrated in FIG. 7. The carton is then closed at the top, and the adhesive-bearing flap 71 is folded over and pressed around the vertical lip 160 at the top of the container to seal it closed as illustrated in FIG. 8. When it is desired to reopen the container, the seal is broken along the perforated edges 82, 84, FIG. 9, and the contents poured out, FIG. 10.

The adhesive and release paper 108 applied to the flap 71 is preferably applied using an adhesive transfer tape, as known in the art. Such transfer tape mauy comprise a continuous, rolled strip of pressuresensitive adhesive applied to a silicon-treated release paper. As the strip is unrolled, one side of the adhesive is exposed and may be applied to the flap 71. Pressure is applied to the adhesive to cause it to adhere to the flap 71, leaving the release paper 108 exposed and ready to be peeled off. The Scotch Joining Systems transfer tapes as manufactured by 3M Company are examples of such adhesive transfer tapes. The formation of the carton blank as shown in FIG. 1 with appropriate scoring and bottom sealing is readily achieved utilizing methods and equipment well-known in the folding carton industry.

Figure 11:
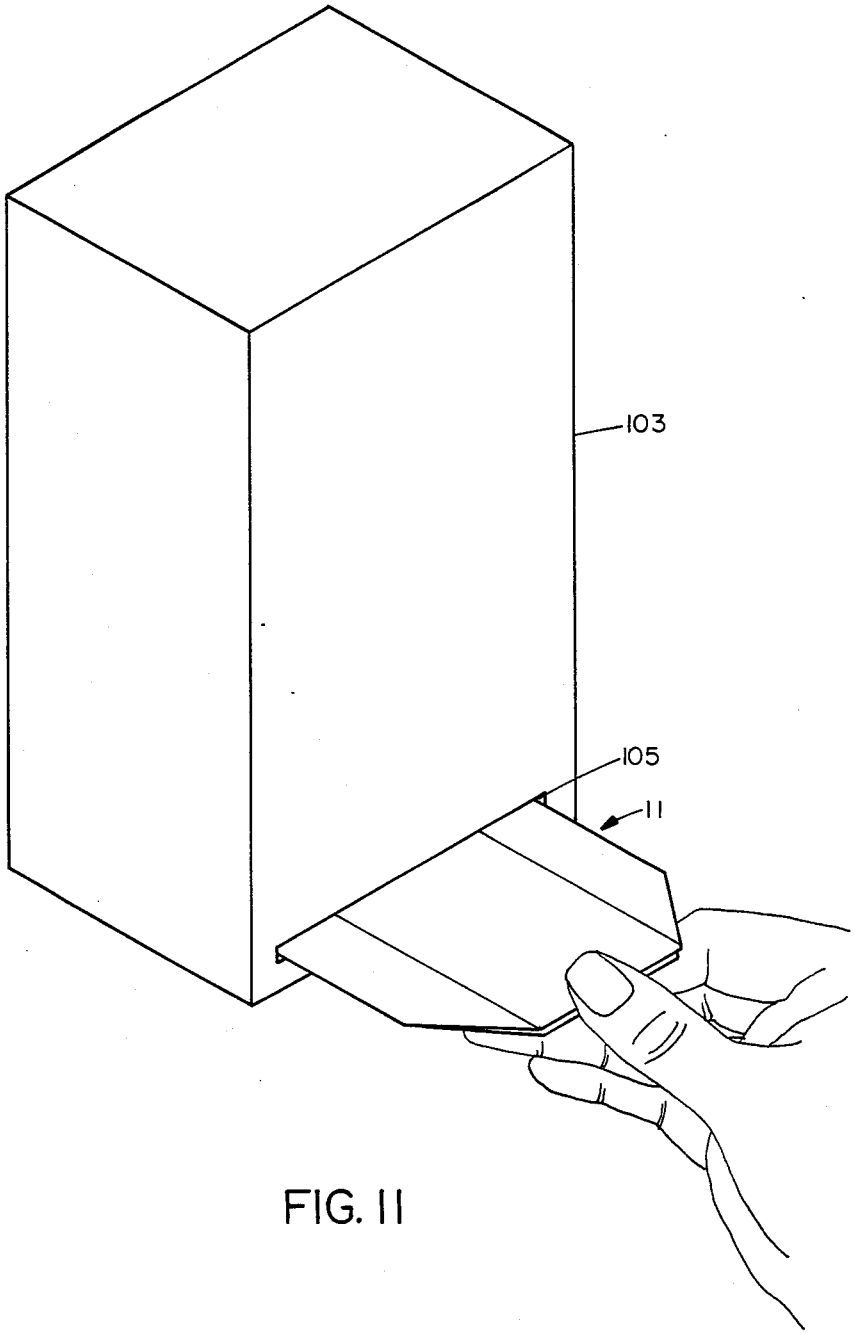
FIG. 11 illustrates the preferred embodiment in conjunction with a dispenser.

FIG. 11 illustrates a dispenser 103, for example, fabricated of cardboard, having a dispenser slot 105 therein. A stack or expandable containers configured according to the invention is stored in the dispenser 103. As illustrated, one container is being withdrawn from the dispenser in its collapsed state. In this state, the container resembles a pouch.

The container of the preferred embodiment admits of numerous uses. It may be used for storage of dry goods (cereals, crackers, grains, flour, powders, etc); liquids (temporary storage, refrigeration, freezing, medical/-laboratory specimens, etc.); and foods (refrigerated, unrefrigerated, for subsequent reheating, transportation from home or restaurant to work or other activity, etc.).

It may be used for collection such as collection of medical/laboratory specimens (urine, feces, sputum, pathology specimens, geological samples, organic and inorganic materials, etc. It may be used for disposal of substances such as kitchen grease, motor oil, sanitary napkins, pet excrement, perishable or distasteful items, etc. It may further be used as an instant container for prepackaged powdered beverages (soups, fruit drinks, medications, coffee, tea, chocolate, etc.), and as a highly portable and space-efficient container for camping, travel, military use, etc.

As those skilled in the art will appreciate, the subject invention is subject to numerous adaptations and modifications. For example, while FIG. 1 illustrates one possible container blank construction and size, the dimensioning of the blank may be varied to create larger or smaller containers. Various coatings may be applied to adapt the container to hold various liquids. Accordingly, it is to be understood that, within the scope of the appended claims, the invention may be practiced other than as specifically described herein.

What is claimed is:

1. A container expandable for use comprising:

a blank, cut, scored, folded, and sealed into a container having four sides, a bottom, and scoring for forming a gabled top with a spout, first and second of said sides being oppositely disposed from one another; and scoring means in said first and second oppositely disposed sides and said bottom permitting flattening of said container such that said oppositely disposed sides collapse outwardly to form collapsed, oppositely disposed sides and such that said bottom collapses inwardly upon itself and further permitting re-expanding of said container for use by application of pressure to the collapsed, oppositely disposed sides;

a vertical lip including score means defining a first side panel of said vertical lip having a first top edge, a middle panel of said vertical lip having a middle top edge, a second panel of said vertical lip having a second top edge, said middle top edge meeting said first and second top edges at respective first and second intersections;

a flap attached to said middle top edge, said flap including:

a first horizontal edge attached by at least one uncut segment to said first top edge;

first vertical score means located at said first intersection for defining a first end tab;

a second horiziontal edge attached by at least one uncut segment to said second top edge; and second vertical score means located at said second intersection for defining a second end tab, wherein said flap is attached to said middle top edge by:

a perforated horizontal score;

an unperforated horizontal score adjacent said perforated horizontal score, and wherein said first vertical score means comprises;

a first perforated vertical score; and a second unperforated vertical score.

2. The container of claim 1 wherein said second vertical score means comprises:

first and second unperforated vertical scores.

3. The container of claim 1 wherein said flap bears a pressure-sensitive adhesive and a release paper strip overlying said adhesive.

4. A container blank comprising:

a flat, foldable material cut and scored to provide first, second, third and fourth panels, each having a top edge;

scoring means in said panels for forming a gabled container top, the gabled container top terminating in a vertical lip having first and second oppositely disposed middle panels formed at the respective top edges of said first and third panels;

first horizontal score means on said second panel for forming a first bottom flap;

second horizontal score means on said fourth panel for forming a second bottom flap;

a first vertical score means extending from the top edge of said second panel to the bottom edge thereof, bisecting said second panel and said first bottom flap;

a second vertical score means extending from the top edge of said fourth panel to the bottom edge thereof, bisecting said fourth panel and said second bottom flap;

said vertical lip further comprising score means defining a first side panel of said vertical lip having a first top edge, and a second side panel of said vertical lip having a second top edge, said first middle panel having a middle top edge meeting said first and second top edges at respective first and second intersections;

said container further including a flap attached to said middle top edge, said flap having:

a first horizontal edge attached by at least one uncut segment to said first top edge;

first vertical scoring means located at said first insersection for defining a first end tab;

a second horizontal edge attached by at least one uncut segment to said second top edge; and second vertical scoring means located at said second intersection for defining a second end tab, and wherein said flap is attached to said middle top edge by:

a perforated horizontal score; and an unperforated horizontal score adjacent said perforated horizontal score.

* * * * *